US009132599B2

(12) United States Patent
Bober

(10) Patent No.: US 9,132,599 B2
(45) Date of Patent: Sep. 15, 2015

(54) SYSTEM AND METHOD FOR IMAGE REGISTRATION FOR PACKAGING

(75) Inventor: Henry T. Bober, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 2140 days.

(21) Appl. No.: 12/205,044

(22) Filed: Sep. 5, 2008

(65) Prior Publication Data

US 2010/0058943 A1 Mar. 11, 2010

(51) Int. Cl.
*B41F 13/02* (2006.01)
*B31B 1/88* (2006.01)
*B31B 1/74* (2006.01)

(52) U.S. Cl.
CPC ... *B31B 1/88* (2013.01); *B31B 1/74* (2013.01); *B41F 13/025* (2013.01); *B31B 2201/88* (2013.01); *B31B 2201/95* (2013.01)

(58) Field of Classification Search
USPC ..... 101/485
See application file for complete search history.

(56) References Cited

U.S. PATENT DOCUMENTS 2,802,666 A * 8/1957 Fothergill ..... 101/211
3,264,983 A * 8/1966 Lewis et al. ..... 101/181
3,276,183 A * 10/1966 Carlisle, Jr. et al. ..... 493/321
3,902,655 A 9/1975 Huffman
4,236,955 A * 12/1980 Prittie ..... 156/353
4,428,287 A * 1/1984 Greiner ..... 101/170
4,719,855 A * 1/1988 Cannon et al. ..... 101/485
5,235,519 A 8/1993 Miura
5,291,583 A 3/1994 Bapat
5,383,392 A * 1/1995 Kowalewski et al. ..... 101/485
5,457,904 A 10/1995 Colvin
5,513,117 A 4/1996 Small
5,518,574 A 5/1996 Yates et al.
5,528,517 A 6/1996 Loken
5,644,979 A * 7/1997 Raney ..... 100/35
5,687,087 A 11/1997 Taggart
5,752,445 A * 5/1998 Ruggiero et al. ..... 101/486
5,768,142 A 6/1998 Jacobs
5,805,784 A 9/1998 Crawford
5,810,487 A * 9/1998 Kano et al. ..... 101/483
5,810,494 A * 9/1998 Menard et al. ..... 347/104
5,812,705 A * 9/1998 Wang et al. ..... 101/115
5,838,574 A 11/1998 Olson et al.

(Continued)

FOREIGN PATENT DOCUMENTS

WO 2005000681 A2 1/2005
WO 2005054983 A2 6/2005

(Continued)

OTHER PUBLICATIONS http/www.esko.com/tmp/080606115325/G2558322_Kongsberg_tables_us_pdf.

(Continued)

*Primary Examiner* — Jill Culler
(74) *Attorney, Agent, or Firm* — Fox Rothschild LLP

(57) ABSTRACT

A system and method of printing an image on corrugated material may include receiving a digital representation of an image. A print target may be printed on a first corrugated material with respect to a print location. It may be determined whether an error distance between the print target and a die cut target is less than a threshold. The print location may be automatically adjusted based on the error distance. The image may be printed on a second corrugated material based on the adjusted print location.

20 Claims, 5 Drawing Sheets

(56) References Cited

U.S. PATENT DOCUMENTS

| | | | | |
|---|---|---|---|---|
| 5,881,538 | A | 3/1999 | Blohm | |
| 5,923,556 | A | 7/1999 | Harris | |
| 6,005,959 | A | 12/1999 | Mohan et al. | |
| 6,090,027 | A | 7/2000 | Brinkman | |
| 6,092,054 | A | 7/2000 | Tackbary et al. | |
| 6,117,061 | A | 9/2000 | Popat et al. | |
| 6,134,018 | A | 10/2000 | Dziesietnik et al. | |
| 6,153,039 | A | 11/2000 | Jacobsen | |
| 6,237,787 | B1 | 5/2001 | Gallo et al. | |
| 6,243,172 | B1 | 6/2001 | Gauthier et al. | |
| 6,246,468 | B1 | 6/2001 | Dimsdale | |
| 6,332,149 | B1 | 12/2001 | Warmus et al. | |
| 6,409,019 | B1 | 6/2002 | Hornsby et al. | |
| 6,687,016 | B2 | 2/2004 | Gauthier | |
| 6,689,035 | B1 | 2/2004 | Gerber | |
| 6,771,387 | B2 | 8/2004 | Gauthier | |
| 6,874,420 | B2 * | 4/2005 | Lewis et al. | 101/485 |
| 6,895,549 | B1 | 5/2005 | Albright et al. | |
| 6,896,250 | B2 | 5/2005 | Hillebrand | |
| 6,939,063 | B2 | 9/2005 | Bussell | |
| 6,948,115 | B2 | 9/2005 | Aizikowitz et al. | |
| 6,953,513 | B1 | 10/2005 | Volkert | |
| 7,013,616 | B1 | 3/2006 | Powers et al. | |
| 7,197,465 | B1 | 3/2007 | Hu et al. | |
| 7,243,303 | B2 | 7/2007 | Purvis et al. | |
| 7,293,652 | B2 | 11/2007 | Learn et al. | |
| 7,327,362 | B2 | 2/2008 | Grau | |
| 7,343,858 | B2 * | 3/2008 | Poulain et al. | 101/485 |
| 7,406,194 | B2 | 7/2008 | Aizikowitz et al. | |
| 7,647,752 | B2 | 1/2010 | Magnell | |
| 7,832,560 | B2 | 11/2010 | Tilton | |
| 2002/0085001 | A1 | 7/2002 | Taylor | |
| 2002/0118874 | A1 | 8/2002 | Chung et al. | |
| 2003/0035138 | A1 | 2/2003 | Schilling | |
| 2003/0083763 | A1 | 5/2003 | Kiyohara et al. | |
| 2003/0091227 | A1 | 5/2003 | Chang et al. | |
| 2003/0164875 | A1 | 9/2003 | Meyers | |
| 2003/0200111 | A1 | 10/2003 | Damji | |
| 2003/0210313 | A1 * | 11/2003 | Nedblake et al. | 347/102 |
| 2004/0073407 | A1 | 4/2004 | Nguyen et al. | |
| 2004/0120603 | A1 | 6/2004 | Gupta | |
| 2005/0005261 | A1 | 1/2005 | Severin | |
| 2005/0050052 | A1 | 3/2005 | Zimmerman et al. | |
| 2005/0249400 | A1 | 11/2005 | Fukumoto | |
| 2006/0080274 | A1 | 4/2006 | Mourad | |
| 2006/0155561 | A1 | 7/2006 | Harper | |
| 2006/0217831 | A1 | 9/2006 | Butterworth et al. | |
| 2006/0284360 | A1 | 12/2006 | Hume et al. | |
| 2007/0041035 | A1 | 2/2007 | Sembower et al. | |
| 2007/0042885 | A1 | 2/2007 | Rietjens et al. | |
| 2007/0112460 | A1 | 5/2007 | Kiselik | |
| 2007/0172986 | A1 | 7/2007 | Huang et al. | |
| 2007/0229641 | A1 * | 10/2007 | Nakazawa | 347/104 |
| 2008/0048308 | A1 | 2/2008 | Lam | |
| 2008/0255945 | A1 | 10/2008 | Percival et al. | |
| 2009/0063381 | A1 | 3/2009 | Chan et al. | |
| 2009/0070213 | A1 | 3/2009 | Miller et al. | |
| 2009/0236752 | A1 | 9/2009 | Lee et al. | |
| 2009/0282782 | A1 | 11/2009 | Walker et al. | |
| 2009/0287632 | A1 | 11/2009 | Gombert et al. | |
| 2009/0287717 | A1 | 11/2009 | Gombert et al. | |
| 2010/0060909 | A1 | 3/2010 | Conescu et al. | |
| 2010/0098319 | A1 | 4/2010 | Gombert et al. | |
| 2010/0110479 | A1 | 5/2010 | Gombert et al. | |

FOREIGN PATENT DOCUMENTS

| | | | |
|---|---|---|---|
| WO | 2005122079 | A2 | 12/2005 |
| WO | WO 2007021920 | | 2/2007 |

OTHER PUBLICATIONS

Liang Lu et al, "Folding Cartons with Fixtures: A Motion Planning Approach", IEEE Transactions on Robotics and Automation, vol. 16, No. 4, Aug. 2000.

* cited by examiner

SYSTEM AND METHOD FOR IMAGE REGISTRATION FOR PACKAGING

BACKGROUND

The disclosed embodiments relate generally to methods and systems for printing images on corrugated material.

Corrugated material is customarily used for packaging containers. For example, corrugated boards are typically made of a paper-based construction material and include a fluted corrugated sheet and one or two flat linerboards.

Information, such as assembly instructions, advertising, a manufacturer's name and/or a logo, is often printed on a corrugated board. However, the board's thickness and wavy surface makes high quality printing on it difficult and inexact.

Current techniques for printing on corrugated material include feeding the material through a print station where flexographic printing occurs. The print station includes various flexographic print rollers and die cutter cylinders. The rollers include a reversed raised copy of the image. Each flexographic roller is associated with a different color ink. When the corrugated material is sent through the print station, the rollers rotate over the corrugated material creating an image. Additionally, one or more die cutter cylinders are used to cut the corrugated material so it can later be folded to create a packaging container.

Adjusting the timing of the rollers and the die cutter cylinders is a time and labor intensive process. Each flexographic roller needs to be manually positioned or timed to place its image in proper registration to the other colors or images. Determining a precise location for each roller is typically performed using an iterative process to ensure both proper placement of the image on the corrugated material and proper color blending between the images produced by each roller. Additionally, the die cutter cylinders must be manually repositioned or timed in order to properly cut the corrugated material.

SUMMARY

In an embodiment, a method of printing an image on corrugated material may include receiving a digital representation of an image. A print target may be printed on a first corrugated material with respect to a print location. It may be determined whether an error distance between the print target and a die cut target is less than a threshold. The print location may be automatically adjusted based on the error distance. The image may be printed on a second corrugated material based on the adjusted print location.

In an embodiment, one or more die cutters may be automatically adjusted based on the error distance. In an embodiment, the print target may be printed using a digital printer or an ultraviolet ink jet printing device. The print target may include, but is not limited to, a shape, a design, a symbol, one or more linear scales, a number and a letter.

In an embodiment, printing the image may include printing multiple colors sequentially on the second corrugated material. A digital representation of an image may include, but is not limited to, a digital representation of a design, a picture, a photograph, a number, an advertisement, a letter, a logo and a trademark.

In an embodiment, it may be determined whether the error distance between the print target and the die cut target is less than an industry standard distance. In an embodiment, it may be determined whether the error distance between the print target and the die cut target is less than a user-specified distance. In an embodiment, it may be determined whether the error distance between the print target and the die cut target is less than approximately 0.5 millimeters. In an embodiment, an adjustment may be determined based on a Cartesian coordinate system. In an embodiment, an adjustment may be determined based on an angle and a length.

In an embodiment, a system of printing an image on corrugated material may include a processor, an assembly device in communication with the processor and a computer readable storage medium in communication with the processor. The computer readable storage medium may contain one or more programming instructions executed by the processor for: receiving a digital representation of an image, printing a print target on a first corrugated material with respect to a print location, determining whether an error distance between the print target and a die cut target is less than a threshold, automatically adjusting the print location based on the error distance and printing the image on a second corrugated material based on the adjusted print location.

In an embodiment, a method of printing an image on corrugated material may include receiving a digital representation of an image. A print target may be printed on a first corrugated material with respect to a print location. It may be determined whether an error distance between the print target and a die cut target is less than a threshold. The print location may be automatically adjusted by adjusting a time at which the print target is printed based on the error distance. The image may be printed on a second corrugated material based on the adjusted print location.

In an embodiment, one or more die cutters may be automatically adjusted based on the error distance. The print target may be printed using a digital printer or an ultraviolet ink jet printing device. In an embodiment, it may be determined whether the error distance between the print target and the die cut target is less than an industry standard distance. In an embodiment, it may be determined whether the error distance between the print target and the die cut target is less than a user-specified distance. In an embodiment, it may be determined whether the error distance between the print target and the die cut target is less than approximately 0.5 millimeters.

BRIEF DESCRIPTION OF THE DRAWINGS

Aspects, features, benefits and advantages of the embodiments described herein will be apparent with regard to the following description, appended claims, and accompanying drawings where:

DETAILED DESCRIPTION

Before the present methods and systems are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

As used herein and in the appended claims, the singular forms "a," "an," and "the" include the plural reference unless the context clearly dictates otherwise. Unless defined otherwise, all technical and scientific terms used herein have the same meanings as commonly understood by one of ordinary skill in the art. As used herein, the term "comprising" means "including, but not limited to."

A "computing device" refers to a system that processes data to perform one or more functions. A computing device may be any processor-based device such as, for example, a server, a personal computer, a personal digital assistant, a web-enabled phone, a smart terminal, a dumb terminal and/or other electronic device capable of processing data and performing functions.

An "assembly device" refers to a device used in an assembly line that performs an operation. For example, an assembly device may be used in a corrugated package construction or corrugated display process. An assembly device may include one or more die cutter cylinders, a printing engine and a target sensor. An assembly device may perform operations such as, but not limited to, printing, cutting, slitting, folding, sealing, gluing, creasing and/or perforating.

The "print target" refers to an object printed with an image which is used to assess printer alignment to the die cut target. The print target may include, but is not limited to, any type of shape, design, symbol, number and/or letter and may include one or more linear measurement scales.

A "die cut target" refers to one or more cuts on a corrugated board from a die cut cylinder which is used to assess printer alignment. The die cut target may include, but is not limited to, a symbol, such as a plus sign, an "x", or a design, such as a bull's eye.

"Process direction" refers to a direction in which an assembly device is designed to move corrugated material during processing.

"Cross process direction" refers to a direction that is perpendicular to the process direction.

A "grid system" describes a point on a map or graph. A Cartesian graph is a type of grid system.

"Top edge registration (TER)" refers to the image position relative to the corrugated material in the cross process direction.

"Leading edge (L/E) registration" refers to the image position relative to the corrugated material in the process direction.

"Waste area" refers to the area of the corrugated material removed by the die cutter cylinders.

"Usable area" refers to any part of the corrugated material which is not part of the waste area.

Figure 1:
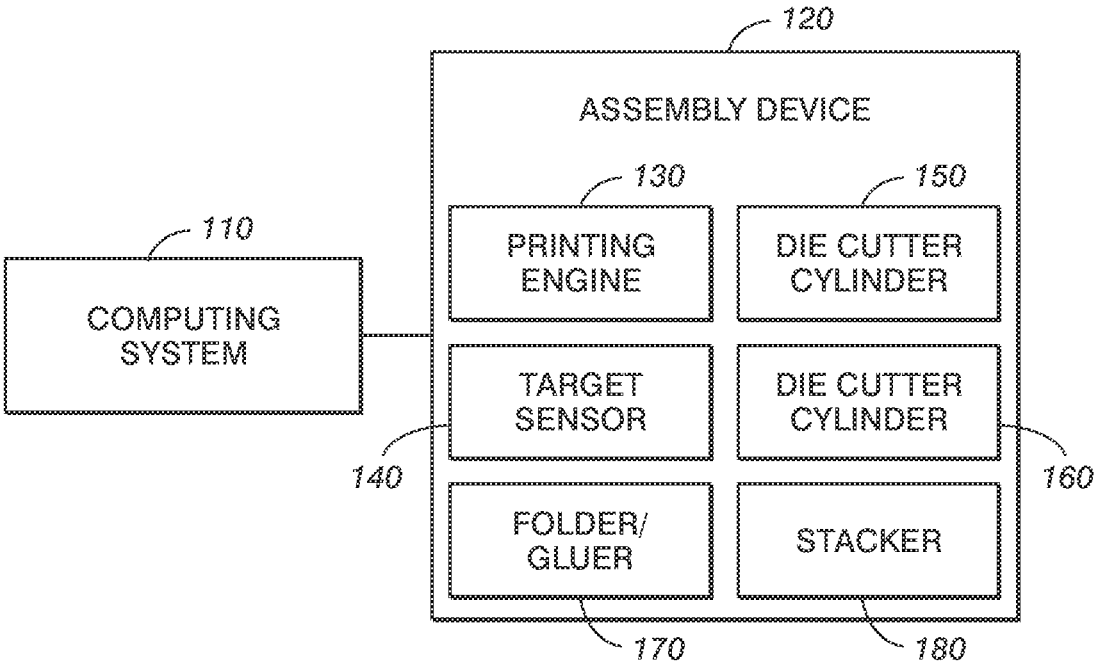
FIG. 1 illustrates a block diagram of an exemplary system for printing an image on corrugated material according to an embodiment.

FIG. 1 illustrates a block diagram of an exemplary system for printing an image on corrugated material according to an embodiment. As shown in FIG. 1, the system may include a production environment An exemplary production environment may include a print shop. A production environment may include a computing system 110 and an assembly device 120. Corrugated material may be delivered to an assembly device 120. An assembly device 120 may include a printing engine 130, such as a color ink jet (IJ) printer, a target sensor 140, one or more die cutter cylinders 150, 160, folders/gluers 170 and stacker 180 for accumulating and stacking finished corrugated material. Die cutter cylinders 150, 160 may include blades or other cutting edges which can be positioned based on the shape of a desired package or display from the corrugated material. The order of the operations discussed in the present embodiment is non-limiting and the operations may occur in any order.

Figure 2:
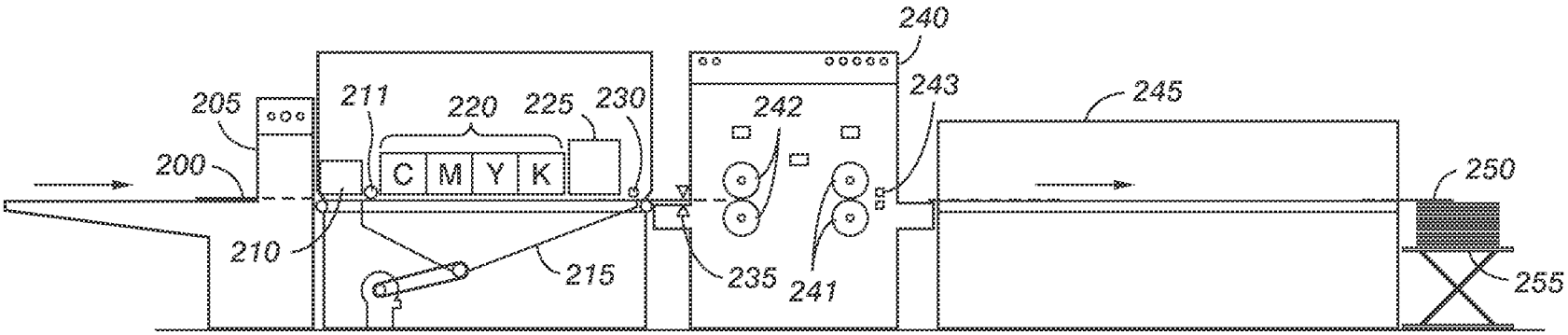
FIG. 2 depicts an exemplary assembly device with ink jet printing for producing corrugated packaging and display materials according to an embodiment.

FIG. 2 depicts an exemplary assembly device with ink jet printing for producing corrugated packaging and display materials according to an embodiment. In an embodiment, corrugated material 200 may enter a media transport system through a corrugated media feeder 205. The corrugated media feeder 205 may be used to individually place the corrugated material 200 into the assembly device. The corrugated material 200 may be cleaned by the corrugated board cleaner 210. The corrugated board cleaner 210 may perform a cleaning operation on the corrugated material 200 through the use of, but without limitation, air, a solvent and/or a brushing device to remove particles and /or other debris from the corrugated material to protect the one or more print heads 220, as discussed below.

A vacuum print platen 215, aided by an acquisition cylinder 211, may be used to flatten the corrugated material 200. In an embodiment, a vacuum print platen 215 may pull the corrugated material 200 towards a conveyer using a suctioning device. The vacuum print platen 215 may be used to keep the corrugated material 200 flat during processing by the assembly device.

One or more print heads 220 may be used to print on the corrugated material 200. A depth of focus (DoF) setting 235 may be adjusted. The DoF setting 235 may be used by the assembly device so that it may more accurately create a high quality image. For example, the DoF setting 235 of the print heads 220 to the corrugated material 200 may be adjusted to enhance the clarity, resolution and quality of a print target and the printed image on the corrugated material.

The printing may include, but is not limited to, digital printing or ultraviolet curable ink jet printing. At a cure station 225, the printed section of the corrugated material 200 may be cured. In an embodiment using ultraviolet curable ink jet printing, a cure station may cure the ink using ultraviolet rays.

The corrugated material may exit through an exit hold down star wheel cylinder or similar device 230. The corrugated material may leave the printing area and enter into the die cut, slot and score area 240. In an embodiment, the slot and score area 240 may form slits, holes, slots and/or creases in the corrugated material 200. After the corrugated board exits the die cut cylinders 241, 242 in the die cut station 240, the target sensor 243 may sense the error distance between the print target and the die cut target. The corrugated material 200 may arrive at a folder and gluer area 245. The folder and gluer area 245 may fold and glue areas of the corrugated material 200 so that, for example, a box may be assembled. The corrugated material 200 may be folded flat 250 and stacked 255. The order of the operations discussed in the present embodiment is non-limiting and the operations may occur in any order.

Figure 3A:
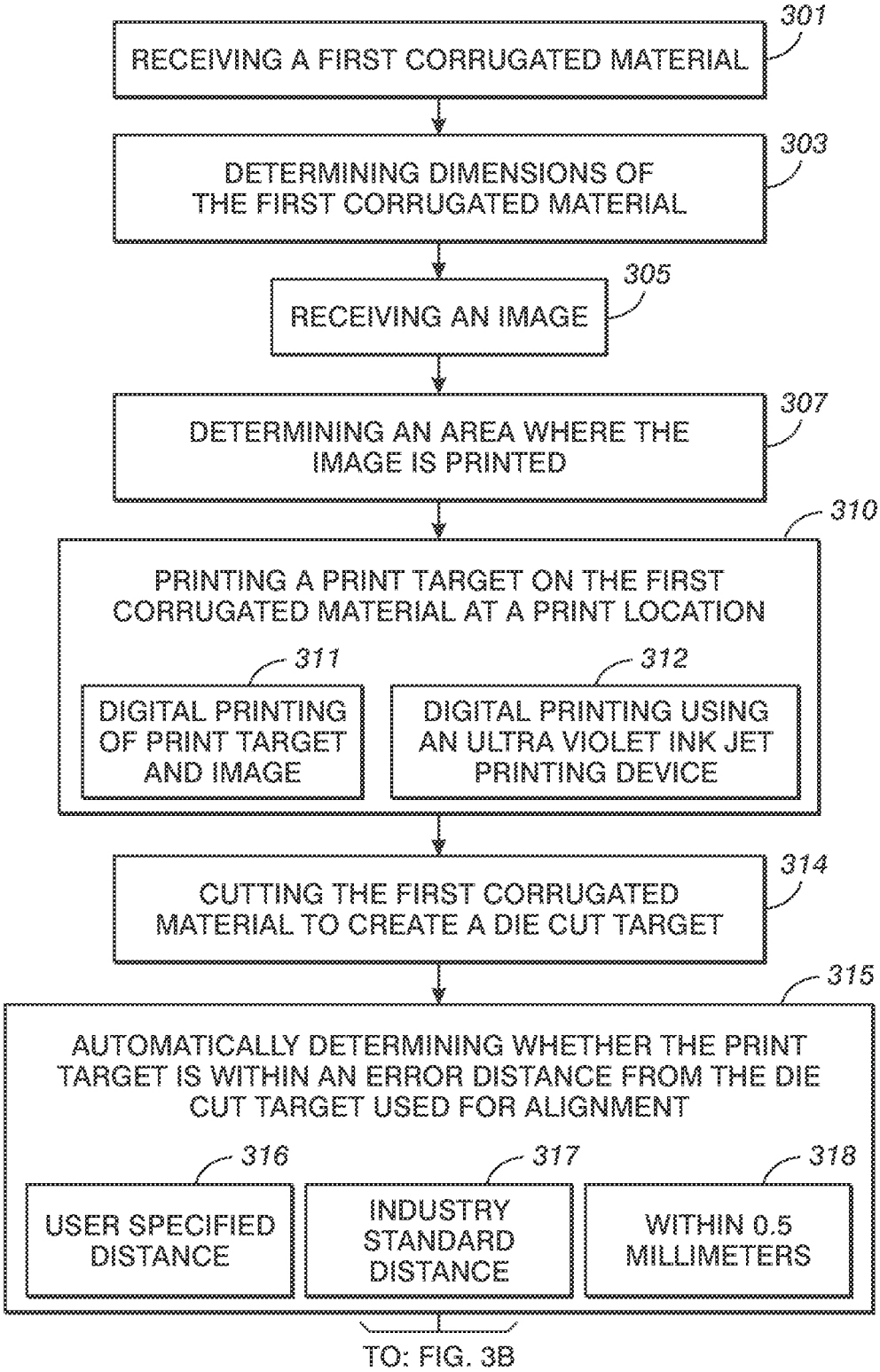
FIGS. 3A and 3B depict a flowchart of an exemplary method of printing an image on corrugated material according to an embodiment.
Figure 3B:
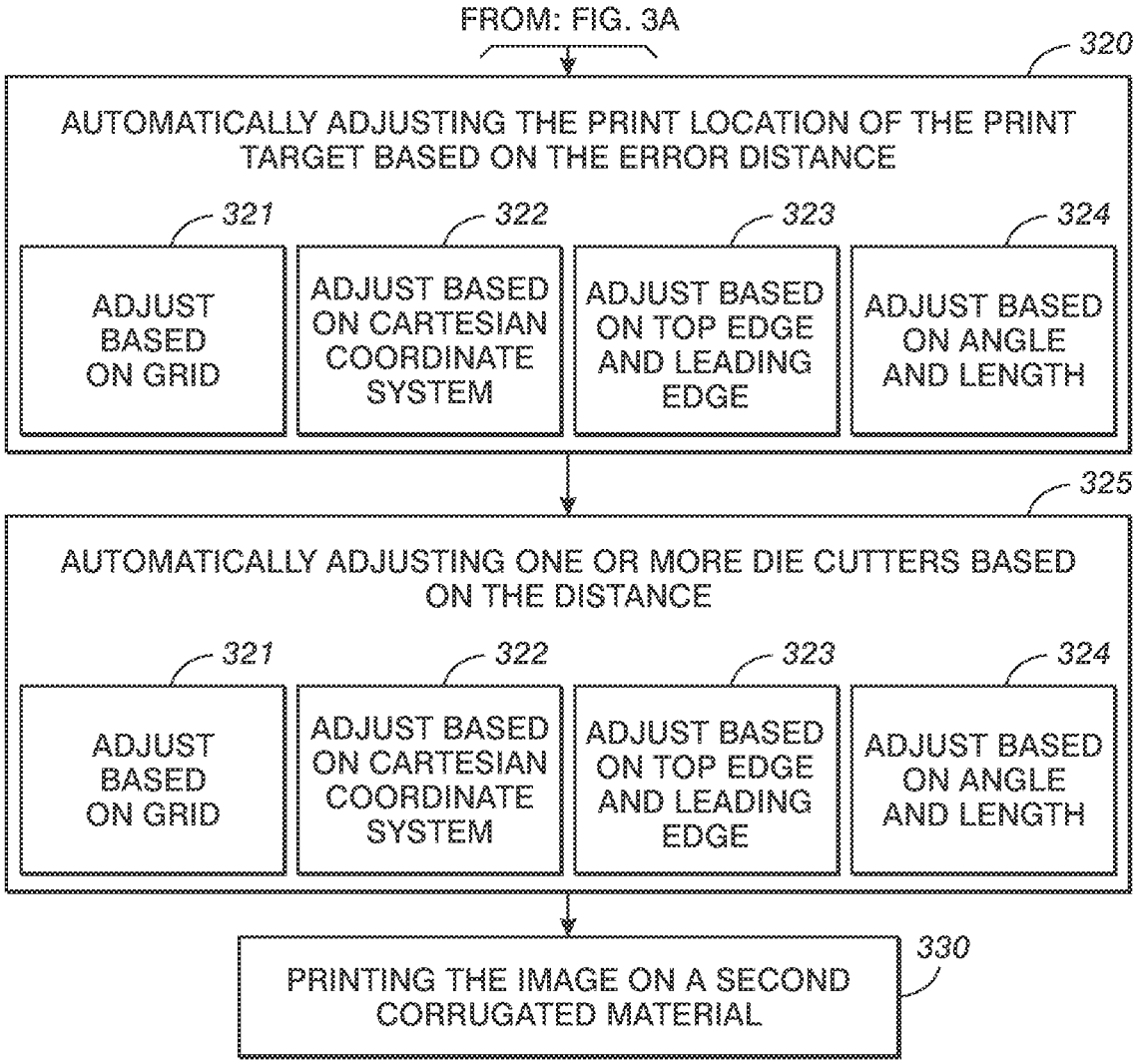

FIGS. 3A and 3B depict a flowchart of an exemplary method of printing an image on corrugated material according to an embodiment. Referring to FIG. 3A, a first corrugated material may be received 301 by the assembly device. The assembly device may include a computing device that determines 303 the dimensions of the corrugated material on which an image is printed. In an embodiment, the dimensions of the corrugated material may be provided by a customer.

The computing device may receive 305 a digital representation of an image. The image may include, but is not limited to, a design, a picture, a photograph, a number, a letter, a logo, identification symbol, container rating, advertising, a trademark and/or any other similar graphical representation.

The computing device may determine 307 an area within which the image is intended to be printed on the corrugated material. In an embodiment, the image may be printed within the usable area of the corrugated material.

A print target may be printed 310 on the first corrugated material at a print location. A print location for the print target may be located within the waste area. The location of the print target may be based on the location of the image within the usable area of the corrugated material. The amount of separation between the print target and the image may be determined by, for example, a user, a size of the image and/or a size of the corrugated material.

In an embodiment, printing may include digital printing 311. In an embodiment, digital printing may occur using an ultraviolet curable ink jet printing device where the ink is printed directly on the corrugated material 312. Digital printing may enable a plurality of colors to be printed sequentially. As such, digital printing may provide improved image and color quality over print systems using printing technologies such as traditional flexographic cylinders, which require a printing cylinder for each color and individual synchronization of each roller with respect to other rollers.

In an embodiment, the corrugated material may be cut 314 using die cutter cylinders to create a die cut target. In an embodiment, cutting the corrugated material may include cutting the outline of the box, any slits, holes, slots, creases and/or a die cut target. In an embodiment, a die cut target may have a fixed relationship with the corrugated material.

The die cut target may be cut into the corrugated material by a die cutter cylinder. In an embodiment, the die cut target may be cut through less than all layers of the corrugated material. For example, a plus sign may be scored into a top layer of the corrugated material.

In an embodiment, the die cut target may be located on an area of the corrugated material which is not part of the completed package. For example, a die cut target may be located within a waste area of the corrugated material.

In an embodiment, the waste area may remain attached to the usable area of the corrugated board after the corrugated board passes through the die cut cylinders. In an embodiment, the waste area may be detached from the usable area of the corrugated board. However, the waste area may be supported by the assembly device and may remain proximate to the usable area of the corrugated material.

The computing device may determine 315 whether an error distance between the print target and a die cut target is less than a threshold. In an embodiment, the threshold may be specified by a user or customer 316. In an embodiment, the threshold may be selected based on the specific needs or use of the corrugated material. In an embodiment, the threshold may be determined based on the type of corrugated material that is used and/or the type of image that is printed. In an embodiment, the threshold may be determined based on an industry standard 317. In an embodiment, the threshold may be approximately 0.5 millimeters 318.

The error distance between the print target and the die cut target may be determined. In an embodiment, a location of the print target may be determined by, without limitation, an optical target sensor, a photo scanner and/or a digital scanner. In an embodiment, a scanner may be in close proximity to the die cutter cylinders.

Referring to FIG. 3B, if the error distance between the print target and the die cut target is not within the threshold, the print location of the print target may be adjusted 320 based on the error distance. In an embodiment, the print location of the print target may be electronically adjusted by moving the print location in the process direction. In an embodiment, the print location may be electronically adjusted by moving the print location in the cross process direction.

In an embodiment, the timing of one or more die cutter cylinders may be automatically adjusted 325. In an embodiment, the one or more die cutter cylinders may be adjusted based on the distance between the print target and the die cut target. In an embodiment, the die cutter cylinder timing may be adjusted by moving the die cutter cylinder in the process direction. In an alternate embodiment, the die cutter cylinder may be mechanically adjusted by moving the die cutter cylinder in the cross process direction.

In an embodiment, the print location and/or the die cutter cylinders may be adjusted based on a grid system 322. For example, the grid system may be based on the Cartesian coordinate system. The origin of a two-dimensional Cartesian grid may be, for example, the center of a corrugated material. A print location and/or a die cutter cylinder may be adjusted based on a point on the Cartesian graph. For example, if the origin of the graph is at the center of the corrugated material, the print location of the print target may currently be located at point (6, 5) on the Cartesian grid. A target sensor may determine that the print target is printed in a location on the corrugated material that is too high and too far to the right as compared to the die cut target. Therefore, the print location may automatically be moved to point (2, 3) on the Cartesian grid.

In an embodiment, the origin of the Cartesian grid may be at a different location such as, but not limited to, the location of the print target. Referring to the example above, the current location of the print target may be point (0, 0) and the print location of the print target may be automatically moved to point (−4, −2) in order to correspond with the die cut target.

In an embodiment, the origin of the Cartesian grid may be at one or more edges of the corrugated material. If the Cartesian grid has an origin at the top left corner, instead of using a point to identify the location of the print target, a top edge registration (TER) and a leading edge (L/E) registration point may be used. For example, the print target point (2, −3) may be L/E 2 and TER 3. In an embodiment, the X axis may be used to refer to the process direction and the Y axis may be used to refer to the cross process direction.

In an embodiment, the print target location may be adjusted by determining an angle and a distance. In an embodiment, the angle may be determined with respect to the process direction. Alternatively, the angle may be determined with respect to a line perpendicular to the process direction. For example, the print target location may need to be moved two inches at a 30 degree angle with respect to the process direction axis.

In an embodiment, the time at which the print target is printed may be adjusted. For example, printing the print target may occur 100 milliseconds later or 100 milliseconds earlier in order to align the print target L/E registration with the die cut target. In an embodiment, the timing of the die cutters may be adjusted as well. In an embodiment, the cross process direction timing and/or position of the image may be electronically adjusted to align the print target to the die cut target in the cross process direction or TER.

Based on the adjusted print location of the print target, the image may be printed on a second corrugated material 330. The image may be printed on a second corrugated material because the print location may have been adjusted since printing the print target on the first corrugated material. Because the distance between the print target and the image is determinable, adjusting the print location of the print target may affect the location of the image.

For example, as discussed above, the print target may be printed on a first corrugated material. Based on the error distance, the print location of the print target may be adjusted. After the adjustment, the error distance may be within the threshold. If the print target is within the threshold, the image may be printed on a second corrugated material. In an embodiment, the print target may be printed along with the image on the second corrugated material. If the print target is printed on the second corrugated board, the error distance may be within the threshold and no adjustment may be necessary.

Figure 4:
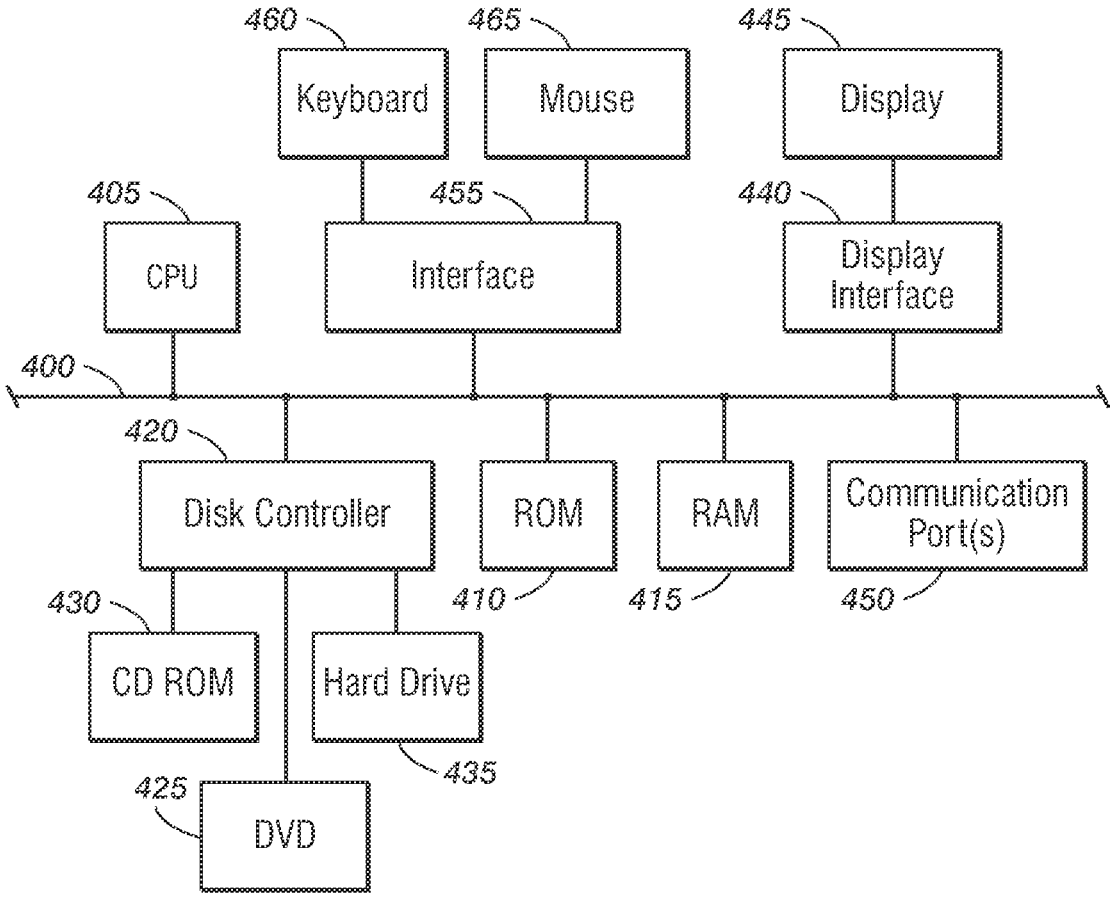
FIG. 4 depicts a block diagram of an exemplary system that may be used to contain or implement program instructions according to an embodiment.

FIG. 4 depicts a block diagram of an exemplary system that may be used to contain or implement program instructions according to an embodiment. Referring to FIG. 4, a bus 400 serves as the main information highway interconnecting the other illustrated components of the hardware. CPU 405 is the central processing unit of the system, performing calculations and logic operations required to execute a program. Read only memory (ROM) 410 and random access memory (RAM) 415 constitute exemplary memory devices or storage media.

A disk controller 420 interfaces with one or more optional disk drives to the system bus 400. These disk drives may include, for example, external or internal DVD drives 425, CD ROM drives 430 or hard drives 435. As indicated previously, these various disk drives and disk controllers are optional devices.

Program instructions may be stored in the ROM 410 and/or the RAM 415. Optionally, program instructions may be stored on a computer readable storage medium, such as a hard drive, a compact disk, a digital disk, a memory or any other tangible recording medium.

An optional display interface 440 may permit information from the bus 400 to be displayed on the display 445 in audio, graphic or alphanumeric format. Communication with external devices may occur using various communication ports 450.

In addition to the standard computer-type components, the hardware may also include an interface 455 which allows for receipt of data from input devices such as a keyboard 460 or other input device 465 such as a mouse, remote control, touch pad or screen, pointer and/or joystick.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of printing an image on corrugated material comprising:

receiving a digital representation of an image;

printing a print target on a first corrugated material at a print location;

determining whether an error distance between the print target and a die cut target is less than a threshold;

automatically adjusting the print location based on the error distance; and printing the image on a second corrugated material at the adjusted print location.

2. The method of claim 1, further comprising:

before the determining, using one or more die cutters to create the die cut target in the first corrugated material; and after the determining, automatically adjusting one or more of the die cutters based on the error distance.

3. The method of claim 2 wherein creating the die cut target comprises:

cutting the die cut target through less than all layers of the first corrugated material in a location that is within a waste area.

4. The method of claim 1 wherein printing a print target comprises:

printing the print target using an ultraviolet curable ink jet printing device.

5. The method of claim 1 wherein printing the image comprises:

printing multiple colors sequentially on the second corrugated material.

6. The method of claim 1 wherein receiving a digital representation of an image comprises receiving a digital representation of one or more of the following: a design, a picture, a photograph, a number, an advertisement, a letter, a logo and a trademark.

7. The method of claim 1 wherein the print target comprises one or more of the following: a shape, a design, a symbol, one or more linear scales, a number and a letter.

8. The method of claim 1 wherein determining whether an error distance between the print target and a die cut target is less than a threshold comprises:

determining whether the error distance between the print target and the die cut target is less than an industry standard distance.

9. The method of claim 1 wherein determining whether an error distance between the print target and a die cut target is less than a threshold comprises:

determining whether the error distance between the print target and the die cut target is less than a user-specified distance.

10. The method of claim 1 wherein determining whether an error distance between the print target and a die cut target is less than a threshold comprises:

determining whether the error distance between the print target and the die cut target is less than approximately 0.5 millimeters.

11. The method of claim 1 wherein automatically adjusting the print location of the print target and the image based on the error distance comprises:

determining an adjustment based on a Cartesian coordinate system.

12. The method of claim 1 wherein automatically adjusting the print location of the print target and the image based on the error distance comprises:

determining an adjustment based on an angle and a length.

13. A system of printing an image on corrugated material comprising:

a processor;

an assembly device in communication with the processor, the assembly device comprising one or more die cutter cylinders, a vacuum print platen, one or more print heads, and a target sensor; and a computer readable storage medium in communication with the processor, wherein the computer readable storage medium contains one or more programming instructions executed by the processor for:

receiving a digital representation of an image;

causing the vacuum print platen to flatten a corrugated material;

causing the one or more print heads to print a print target on the corrugated material;

causing the one or more die cutter cylinders to form a die cut target in the corrugated material;

causing the target sensor to detect an error distance between the print target and the die cut target;

determining whether the error distance is less than a threshold;

automatically determining an adjusted print location based on the error distance; and printing the image on the corrugated material based on the adjusted print location.

14. A method of printing an image on corrugated material comprising:

receiving a digital representation of an image;

printing a print target on a first corrugated material with respect to a print location;

determining whether an error distance between the print target and a die cut target is less than a threshold;

automatically adjusting the print location by adjusting a time at which the print target is printed based on the error distance;

printing the image on a second corrugated material based on the adjusted print location.

15. The method of claim 14, further comprising:

before the determining, using one or more die cutters to create the die cut target in the first corrugated material; and after the determining, automatically adjusting one or more of the die cutters based on the error distance.

16. The method of claim 15 wherein creating the die cut target comprises:

cutting the die cut target through less than all layers of the first corrugated material in a location that is within a waste area.

17. The method of claim 14 wherein printing a print target comprises:

printing the print target using an ultraviolet curable ink jet printing device.

18. The method of claim 14 wherein determining whether an error distance between the print target and a die cut target is less than a threshold comprises:

determining whether the error distance between the print target and the die cut target is less than an industry standard distance.

19. The method of claim 14 wherein determining whether an error distance between the print target and a die cut target is less than a threshold comprises:

determining whether the error distance between the print target and the die cut target is less than a user-specified distance.

20. The method of claim 14 wherein determining whether an error distance between the print target and a die cut target is less than a threshold comprises:

determining whether the error distance between the print target and the die cut target is less than approximately 0.5 millimeters.

* * * * *